United States Patent [19]

Paterson

[11] Patent Number: 5,007,206

[45] Date of Patent: Apr. 16, 1991

[54] DUSTLESS DRYWALL SANDER

[76] Inventor: Patrick J. Paterson, Box 354, Ile Des Chene, Manitoba, Canada, R0A 0T0

[21] Appl. No.: 417,455

[22] Filed: Oct. 5, 1989

[51] Int. Cl.[5] ..... B24B 23/00

[52] U.S. Cl. ..... 51/170 R; 51/180; 51/273

[58] Field of Search ..... 51/170 R, 180, 391, 51/393, 273, 407

[56] References Cited

U.S. PATENT DOCUMENTS

| | | | |
|---|---|---|---|
| 3,785,092 | 1/1974 | Hutchins | 51/273 |
| 4,062,152 | 12/1977 | Mehrer . | |
| 4,759,155 | 7/1988 | Shaw . | |
| 4,766,701 | 8/1988 | Roestenberg . | |
| 4,779,385 | 10/1988 | Reiter | 51/180 |

*Primary Examiner*—Maurina Rachuba

*Attorney, Agent, or Firm*—Murray E. Thrift; Stanley G. Ade; Adrian D. Battison

[57] ABSTRACT

A dustless sander has a sanding body with a flat front face. Two exhaust openings open into the back face of the sanding body. Each is associated with a series of vacuum passages that radiate from the exhaust opening. Inlet openings through the front face communicate with the exhaust openings and the vacuum passages. The inlet openings communicating directly with the exhaust openings are smaller in diameter than the inlet openings communicating with the vacuum passages. The sander is equipped with a sanding pad consisting of several layers of fibreglass screen secured together by a bonding material around the edge. This is laid over the front face of the sander and is held in place by an open mesh abrasive sheet clamped to the sander. A hollow handle communicated with the exhaust openings and is connected, through a flexible hose and a rotary joint, to a vacuum source, such as shop vacuum.

15 Claims, 3 Drawing Sheets

DUSTLESS DRYWALL SANDER

FIELD OF THE INVENTION

The present invention relates to sanding apparatus and more particularly to a vacuum sanding apparatus for sanding surfaces and collecting the fine material produced by the sanding operation.

BACKGROUND

In the installation of drywall (gypsum board) walls, a filling compound, known as drywall compound, is applied to the seams between the adjacent panels to fill those seams. Once the drywall compound is set, it is sanded to produce a smooth, even surface with the adjacent panel surfaces. The dust produced by sanding the drywall compound is an extremely fine powder which tends to stay in suspension in the air for a long period of time. It is a highly pervasive material that can enter the lungs, nose, eyes and even the pores of the skin. It is the single most serious health hazard for drywall workers. In addition, the dust settles on everything near the sanding site and usually requires several cleanings before it has all been collected.

Attempts to solve this problem include those described in Mehrer U.S. Pat. No. 4,062,152 issued Dec. 13, 1977 and Shaw U.S. Pat. No. 4,759,155 issued July 26, 1988.

In Mehrer, a sander has a hollow body with a series of vacuum ports uniformly distributed over a front face of the body, leading into the vacuum chamber. An abrasive, air permeable sheet is clamped over the front face of the body and a vacuum is applied to the inside of the body through a hollow handle connected to the body by a universal joint, in order to draw the sanded off particles into the body and handle.

In Shaw, a similar type of device has a rectangular grid of grooves formed in the front face to distribute the vacuum more uniformly over the back face of the abrasive sheet.

In both of these prior art devices, the body is hollow, with a large internal chamber. This tends to stagnate the flow drawing the dust in through the inlet ports, so that the dust will tend to settle in the body. In addition, even with the grooves of the Shaw patent, the abrasive sheet is supported by ungrooved areas of the sander body front face s that no air flow is possible through the supported portions of the abrasive material.

SUMMARY OF THE INVENTION

It is the aim of the present invention to provide a sanding apparatus in which a dust collecting vacuum is applied more uniformly over the backside of a porous, abrasive sheet than has heretofore been the case.

According to one aspect of the present invention there is provided a sanding apparatus comprising:

- a body with a flat front face and a rear face;
- vacuum passage means in the body;
- a plurality of spaced apart inlet openings through the front face of the body, communicating with the vacuum passage means;
- at least one exhaust opening in the body, communicating with the vacuum passage means;
- a handle secured to the body and having a vacuum duct therethrough, the vacuum duct communicating with the vacuum passage means through the exhaust opening;

- a sanding pad comprising a plurality of layers of screen material overlying the front face of the body;
- a porous abrasive mesh overlying the sanding pad; and
- clamp means for clamping the abrasive mesh to the body.

The use of an air pervious sanding pad over-lying the front face of the body provides a uniform vacuum distribution over the back side of the abrasive sheet. The vacuum is not limited to certain areas, so that dust can be drawn through the entire porous abrasive sheet, limiting clogging of any area. The sanding pad also provides a degree of flexibility, which yields a better sanding action. With drywall, the pad prevents scuffing of the paper covering, which is difficult to patch.

According to another aspect of the present invention there is provided a sanding apparatus comprising a body with a flat front face and a back face, at least one exhaust opening through the back face of the body, a plurality of vacuum passages in the body radiating from the exhaust opening, and a plurality of air inlets through the front face of the body communicating with the vacuum passages and the exhaust opening.

The body preferably has two circular exhaust openings with vacuum passages radiating from each one. There are inlets opening into the vacuum passages and the exhaust openings through the front face of the body, with the inlets opening into exhaust openings being smaller than the inlets opening into the vacuum passages. This provides for a more uniform distribution of vacuum over the front face of the sander body. It also provides a relatively low volume, low cross section flow system through the body, s that there is little chance of flow stagnation and consequent settling of dust.

BRIEF DESCRIPTION OF THE DRAWINGS

In the accompanying drawings, which illustrate an exemplary embodiment of the present invention.

DETAILED DESCRIPTION

Figure 1:
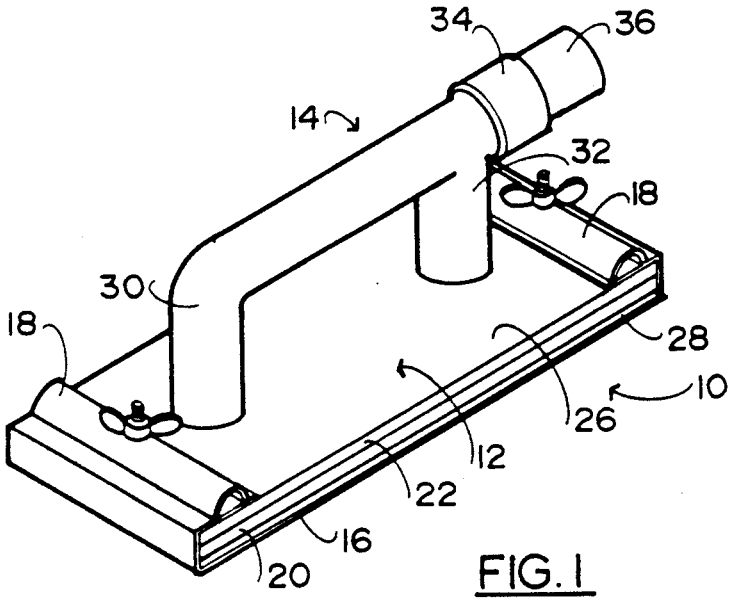
FIG. 1 is an isometric view of a sander according to the present invention.

Referring to the accompanying drawings, there is illustrated a sander 10 with a rectangular body 12 carried on a handle 14. An abrasive sheet 16 extends over the front face of the body 12 and is held in place by two clamps 18.

The body 12 is constructed of two parts, a front part 20 and a back part 22. The front part has a flat front face 24 while the back part 22 has a parallel back face 26. A sanding pad 28 lies on the front face 24, between the front face and the abrasive sheet 16.

The handle 14 of the body includes two tubes 30 and 32 connected in an F-shape with the two arms of the F secured to the back face 26 of the body. The end of the handle includes a rotary joint 34 and a hose coupling 36 for connecting the end of the handle to a hose leading to a shop vacuum source, such as a shop vacuum.

Figure 2:
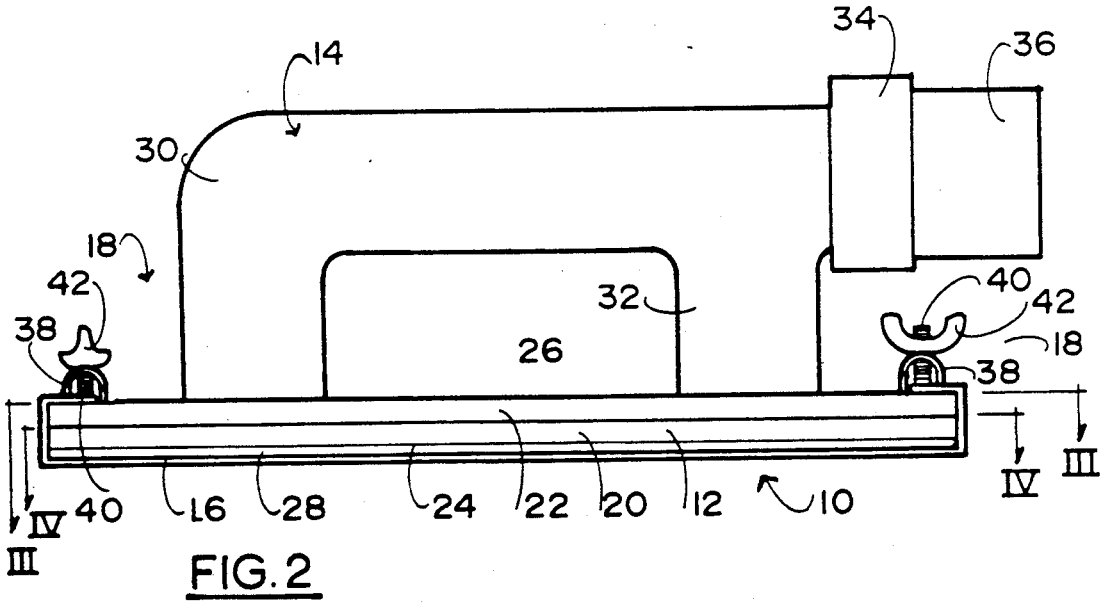
FIG. 2 is a side elevation of the sander of FIG. 1.
Figure 3:
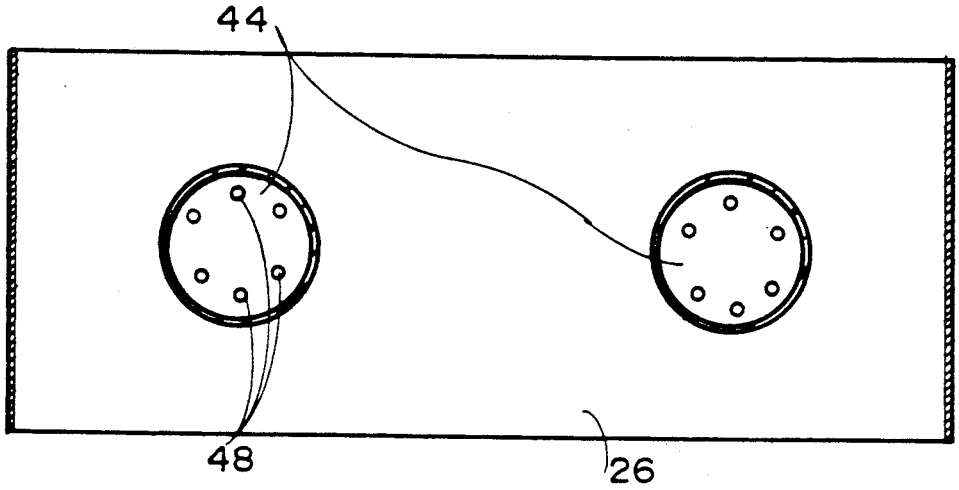
FIG. 3 is a section along line III—III of FIG. 2.
Figure 4:
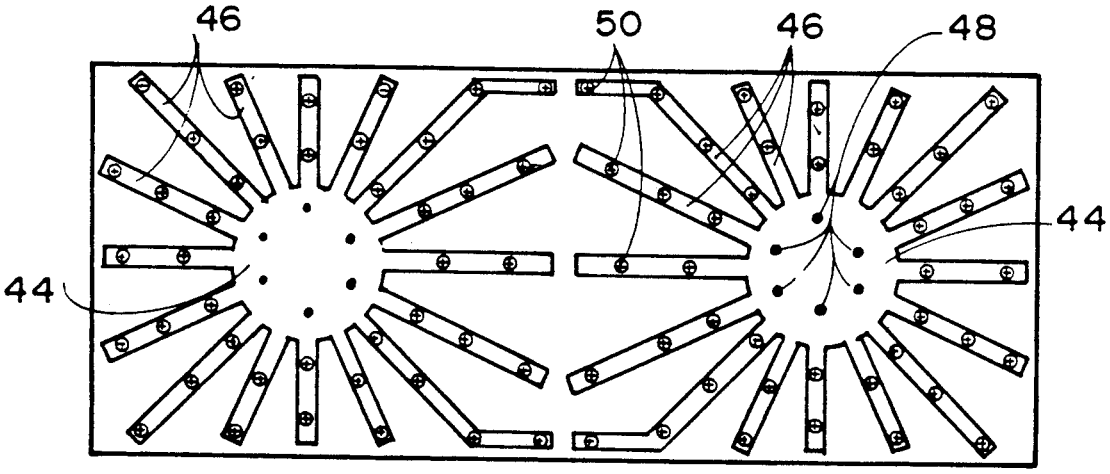
FIG. 4 is a section along line IV—IV of FIG. 2.
Figure 5:
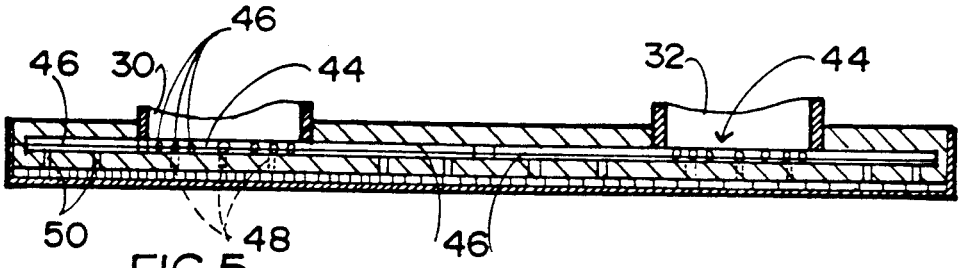
FIG. 5 is a section along line V—V of FIG. 3.
Figure 6:
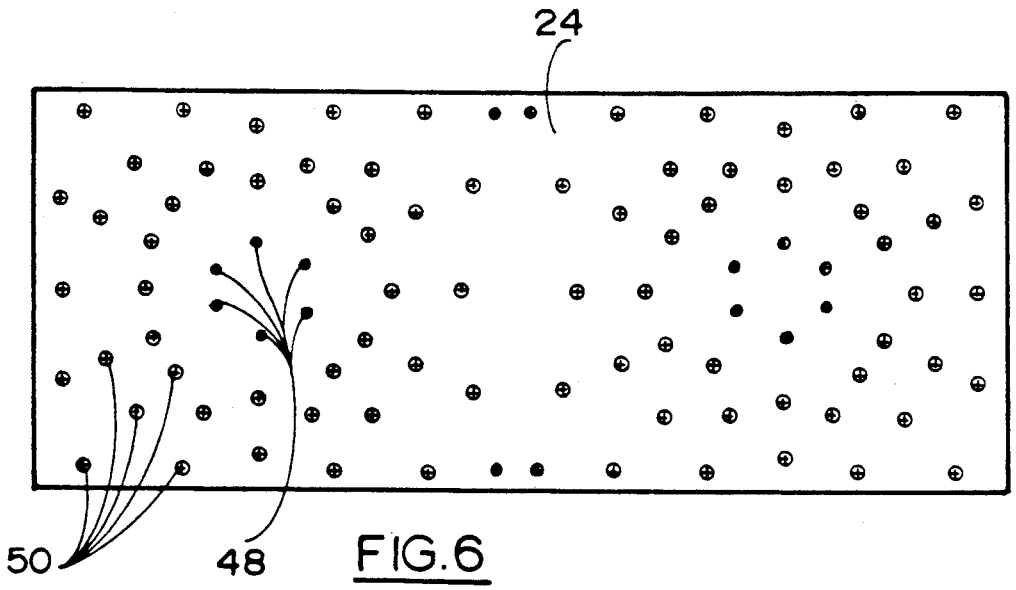
FIG. 6 is a plan view of the front face of the sander body.

The configuration of the clamps 18 is most particularly illustrated in FIGS. 1 and 2. Each clamp includes a clamp bar 38 in the form of a channel with its open side facing the back face of the sander body. A stud 40 projects from the back face through an opening in the channel. A wing nut 42 is threaded on the stud. The abrasive sheet 16, which is an open mesh sanding sheet, lies on the front face of the sanding pad 28, wraps around the ends of the sander body 12 and is clamped in place under the clamp bars 38 using the wing nuts 42.

The internal structure of the sander body 12 is illustrated in FIGS. 3 through 6. The body has two circular exhaust openings 44 that communicate through the back face 26 of the body with the handle tubes 30 and 32 respectively. A series of vacuum passages 46 radiates from each of the exhaust openings 44 at the interface between the front body part 20 and the back body part 22. Six inlet openings 48 open into each exhaust opening 44 through the front face 24 of the body. Each of these openings is of two millimetres diameter. Inlet openings 50 open through the front face 24 of the body into the vacuum passages 46. These openings are spaced along the vacuum passages and have a diameter of three millimetres.

Figure 7:
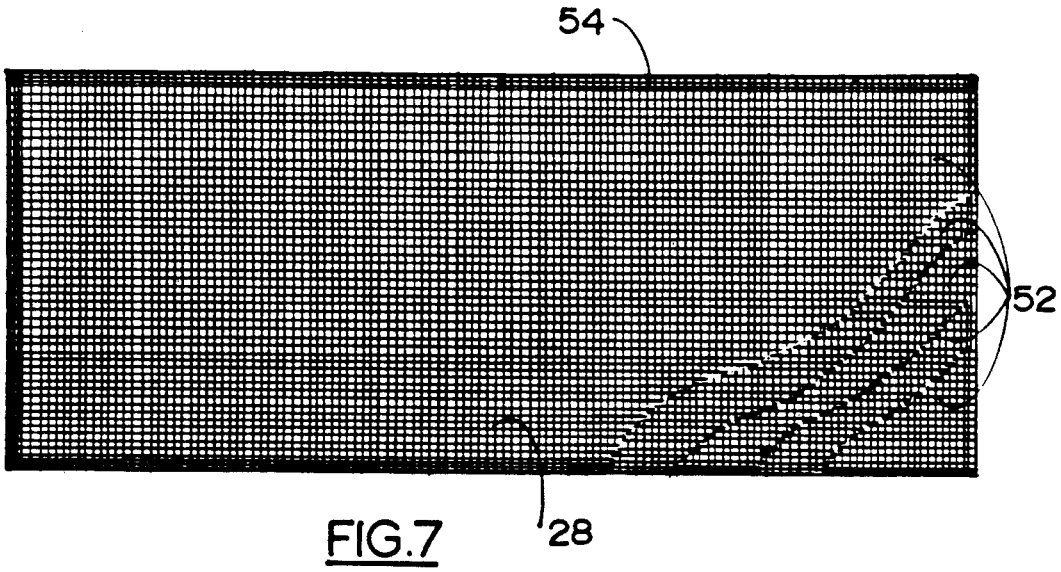
FIG. 7 is a plan view of a sanding pad, partially broken away to show the several layers.

The configuration of the sanding pad is most particularly illustrated in FIG. 7. The pad 28 consists of five layers 52 of fibreglass screen laid on one another and secured together by a bonding material 54 along the edges. This screen provides an air and dust pervious support for the abrasive sheet 16, drawing air through the entire surface of the sheet 16. The vacuum applied to the sanding pad 28 is substantially uniform because of the arrangement of exhaust openings 44 and radiating vacuum passages, with their differently sized inlet openings. Dust is drawn through the sanding pad, through the inlet openings and the vacuum passages into the hollow handle, which serves as a header. The handle is connected to the vacuum source by a flexible hose. The rotating joint at the hose of the handle helps eliminate any torque that might be applied to the handle by the hose.

Where desired, the sander may be mounted on a long handle or pole to provide access to hard to reach and high areas without resort to the use of a ladder.

While one embodiment of the present invention has been described in the foregoing, it is to be understood that other embodiments are possible within the scope of the present invention. For example, the sanding pad may be made with other than five layers of mesh, for example eight, and it may have a variation in mesh sizes, increasingly coarse from the abrasive towards the body. It is therefore to be understood that the invention is to be considered limited solely by the scope of the appended claims.

I claim:

1. A sanding apparatus comprising:

a body with a flat front face and a rear face;

vacuum passage means in the body;

a plurality of spaced apart inlet openings through the front face of the body, communicating with the vacuum passage means;

at least one exhaust opening in the body, communicating with the vacuum passage means;

a handle secured to the body and having a vacuum duct therethrough, the vacuum duct communicating with the vacuum passage means through the exhaust opening:

a flexible sanding pad comprising a plurality of layers of an open mesh screen material, the pad being unattached to and removably overlying the front face of the body;

a porous abrasive mesh overlying the sanding pad; and clamp means for clamping the abrasive mesh to the body whereby the sanding pad is held on the front face of the body by the abrasive mesh.

2. An apparatus according to claim 1 wherein the sanding pad comprises plural layers of fibreglass screen.

3. Apparatus according to claim 2 wherein the layers of screen are bonded together along edges thereof.

4. Apparatus according to claim 1 wherein the vacuum passage means comprise a plurality of passages radiating from each exhaust opening, the inlet openings comprising openings spaced apart along each passage.

5. Apparatus according to claim 4 including two exhaust openings in the body.

6. Apparatus according to claim 5 including a plurality of inlet openings through the front face of the body communicating with each exhaust opening.

7. Apparatus according to claim 6 wherein the inlet openings communicating with the exhaust openings are smaller in size than the inlet openings spaced apart along the passages.

8. Apparatus according to claim 7 wherein the handle comprises a header connected to the body and communicating with the exhaust openings.

9. Apparatus according to claim 8 wherein the handle comprises a rotatable joint connected to the header for coupling the header to a vacuum hose.

10. Apparatus according to claim 1 wherein the clamp means comprise clamp bars extending across the back face of the body adjacent opposite ends thereof and means for forcing the clamp bars against the back face.

11. A sanding apparatus comprising a body with a flat front face and a back face, at least one exhaust opening through the back face of the body, a plurality of independent, unbranched vacuum passages in the body radiating from the exhaust opening, and a plurality of air inlets through the front face of the body communicating with each of the vacuum passages and the exhaust opening.

12. Apparatus according to claim 11 including a plurality of exhaust openings, each with a plurality of independent, unbranched vacuum passages radiating therefrom and air inlets through the front face of the body communicating with each exhaust opening and each vacuum passage.

13. Apparatus according to claim 12 including two exhaust openings.

14. Apparatus according to claim 13 wherein the inlets communicating with the vacuum passages are larger in area that the inlets communicating with the exhaust openings.

15. Apparatus according to claim 14 including a handle secured to the back face of the body and comprising a vacuum duct in communication with the exhaust openings.

* * * * *